United States Patent [19]

Brown

[11] Patent Number: 4,669,130

[45] Date of Patent: Jun. 2, 1987

[54] GARMENT CONSTRUCTION

[76] Inventor: Joseph Brown, 15 Dundonald St. #2303, Toronto, Ontario, Canada, M4Y 1K4

[21] Appl. No.: 831,625

[22] Filed: Feb. 21, 1986

[51] Int. Cl.[4] ..... A41D 1/06

[52] U.S. Cl. ..... 2/227; 2/403

[58] Field of Search ..... 2/227, 228, 229, 403, 2/237, 238

[56] References Cited

U.S. PATENT DOCUMENTS

| | | | |
|---|---|---|---|
| 3,555,569 | 1/1971 | Jones | 2/237 X |
| 3,793,646 | 2/1974 | Tempelhof | 2/227 |
| 4,004,297 | 1/1977 | Polack | 2/227 |

*Primary Examiner*—H. Hampton Hunter

*Attorney, Agent, or Firm*—George A. Rolston

[57] ABSTRACT

A garment construction having a front panel and a back panel, and in which the back panel has: a seat portion for covering the seat and back, and two leg portions all cut integrally out of a single panel, and the upper edge of the seat portion defines a curved edge, and the lower region of the seat portion defines a lower curved edge extending partially into the seat region, and in which the front panel has an abdomen portion and two leg portions, all cut integrally out of a single panel, and the upper edge of the abdomen portion defines a generally downwardly curved edge, and, the lower edge of the abdomen portion defines a downward extension of this abdomen portion extending between the legs, and through the crotch area and, being shaped and joined to the lower edge of the back panel.

2 Claims, 6 Drawing Figures

GARMENT CONSTRUCTION

The invention relates to the construction of garments for the lower trunk, such as briefs and trousers, and in particular to trousers made of two separate panels.

BACKGROUND OF THE INVENTION

Conventional trousers are usually formed with four panels of material, with seams up the outside of the leg and hip, and up the inside of the leg, and also up the centre of the seat and the centre of the abdomen.

These four panels are joined, in the crotch area, by seams.

The location of the four seams through the crotch area, leads to the bunching of several thicknesses of fabric in this region.

For various health reasons it is considered desirable to as far as possible reduce the overlapping of several thicknesses of fabric in the crotch area, and as far as possible to cover the crotch area with only a single thickness of fabric.

In addition, it is considered desirable to provide a trouser construction in which the waist band in the area of the abdomen is cut lower than on conventional trousers, thereby avoiding constriction of the abdomen which, it is believed, leads to interference with the digestive tract.

One form of improved trouser construction is shown in U.S. Pat. No. 4,004,297.

The present invention utilizes some of the teaching of the aforesaid patent, in a more developed form.

BRIEF SUMMARY OF THE INVENTION

With a view to overcoming the various problems described above, the invention comprises a garment construction comprising a front panel and a back panel, and wherein said back panel comprises a seat portion for covering the seat and back, and two leg portions all cut integrally out of a single panel, and wherein the upper edge of the seat portion defines a generally upwardly curved edge, and wherein the lower region of said seat portion defines a lower concavely curved edge extending partially into the seat region, and wherein said front panel comprises an abdomen portion for covering the front of the lower trunk, and two leg portions, all cut integrally out of a single panel, and wherein the upper edge of the abdomen portion defines a generally downwardly curved edge, and wherein the lower edge of said abdomen portion defines a downward extension of said abdomen portion extending between the legs, and through the crotch area and, being shaped and adapted to be joined to said lower concave edge of said back panel.

More particularly, it is an objective of the invention to provide a garment construction having the foregoing advantages wherein the crotch panel extends as a single integral strip from the abdomen panel through to the rear of the crotch area, as a single thickness of fabric, and wherein the edges of said crotch portion extend partly down the inside of the upper leg on each side of the crotch.

More particularly, it is an objective of the invention to provide a trouser construction having the foregoing advantages wherein the front and back panels are joined by seams along the outside of the leg area, extending from the waist to the cuff of the trouser, and by further seams down the inside of the leg area, said further seams commencing at a point below the crotch, thereby eliminating the intersection of seams in the crotch area of the trouser.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
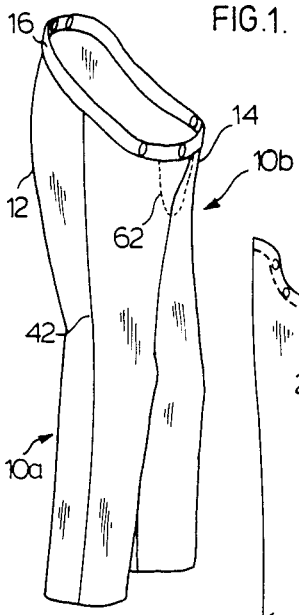
FIG. 1 is a perspective illustration of a pair of trousers made according to the invention, partially cut away to reveal the construction.

Referring first of all to FIG. 1, the trouser construction according to the invention provides two leg portions indicated generally as 10*a* and 10*b*, a seat portion indicated as 12, and an abdomen portion indicated as 14.

A waistband indicated generally as 16 extends from a high point in the centre of the back, to a low point in the centre of the trunk.

This construction is illustrated in more detail in U.S. Pat. No. 4,004,297, wherein the advantages of such construction are fully described.

Preferably, the waistband 16 will be formed of elastic for reasons to be described below.

In addition, the interior of the trousers, near the waistband will be provided with some form of attachment means described in the aforesaid U.S. Letters Patent, either in the form of buttons, hooks, or other attachments whereby the trousers can be attached to the shirt (not shown, but illustrated in the aforesaid U.S. patent).

It will be also noted that there is no frontal opening in the front of the abdomen, and therefore there are no overlapping thicknesses of material or fabric in this region.

Figure 2:
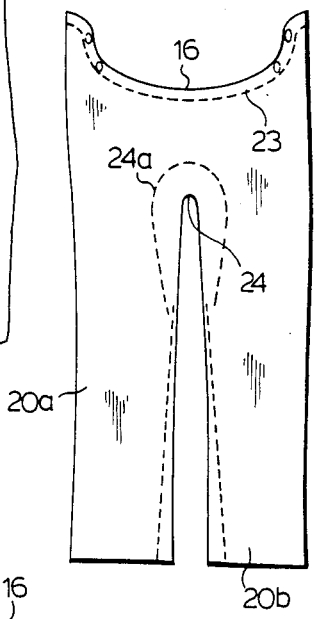
FIG. 2 is a front elevation of the front panel.
Figure 3:
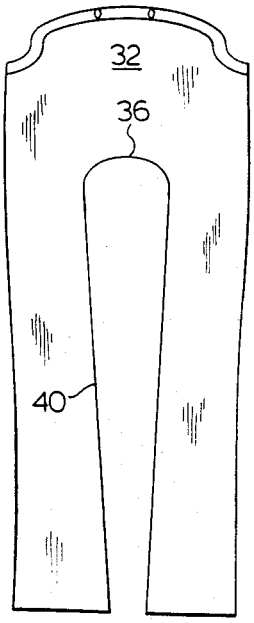
FIG. 3 is a front elevation of the back panel.

In accordance with this invention, the trousers illustrated in FIG. 1 are made up of two separate panels, namely a front panel 20 (FIG. 2) and a back panel 30 (FIG. 3).

Referring first of all to FIG. 2, the front panel 20 will be seen to comprise leg portions 20*a*, 20*b*, and a frontal abdominal portion 22. The upper edge 23 of the frontal abdominal portion 22 is of generally downwardly curved shape.

A central crotch panel 24 extends downwardly from the frontal abdominal portion 22. This panel is of curved shape and extends below a phantom line 24*a*, which indicates the lower edge of portion 22.

In any event, it is of substantial width in the crotch area between the legs, and is deep enough to extend through to the rear of the crotch area to meet the back panel, as will be described below.

Leg portions 20*a*–20*b* are wider at their upper ends and define angled inside edges 26, whereby to define angled seams with the inside edges of the back panel described below.

Referring now to FIG. 3, the back panel 30 will be seen to comprise leg portions 30*a–b*, and a seat portion 32 all formed of a single panel of fabric.

The upper edge 34 has a generally upwardly curved shape.

A generally curved notch 36 is cut out of the centre of the seat portion between the two legs 30*a–b*.

This notch is intended to join the crotch panel of the front panel of FIG. 2.

The inside edges 36 of back leg portions 30*a–30b* are angled so as to be farther apart at their upper ends and converge towards their lower ends.

Figure 4:
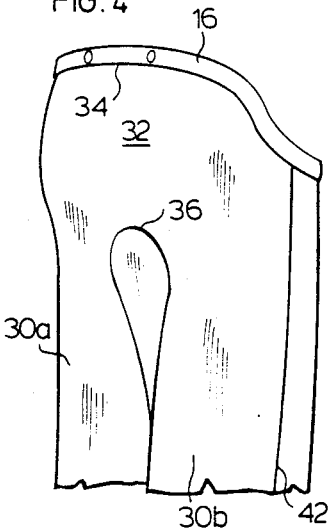
FIG. 4 is a lower rear perspective view showing the crotch and seat areas of the trousers.
Figure 5:
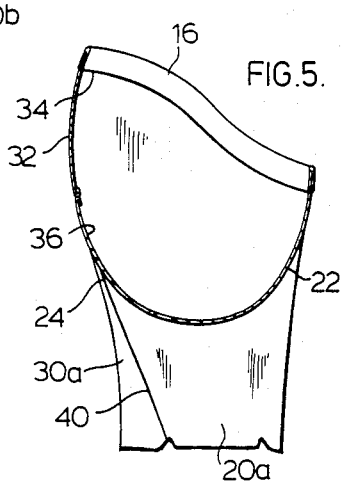
FIG. 5 is a side section of FIG. 1.

As best shown in FIG. 4, the arrangement of the seams in the crotch area and seat portion can readily be understood. It will be seen that the front and back trouser panels 20 and 30 are joined along their inner edges by seams 40, and along their outer edges by seams 42.

The crotch panel is joined to the edges of the notch 36 in the back panel 30 by the upper extension of seams 42.

It will of course be appreciated that seams 42 form a continuous curved seam extending from the inside of each leg, up through the seat.

It will, however, be seen that in this form of construction the area through the centre of the crotch is completely free of seams, and is in fact constituted by a single thickness of fabric.

Any seams are located well down the inside of the leg and to the rear of the crotch area.

The inside seams 40 are angled rearwardly so that they extend from a median point adjacent the inside of the ankle or lower end of the trousers, to a point adjacent the lower region of the buttocks.

The seams 40 thus avoid the crotch area altogether.

This form of construction has numerous advantages from the viewpoint of the health and comfort of the wearer, due to the absence of the accumulation of many thicknesses of fabric in the crotch area.

Typically the waist band will have a "rise" of about 6 inches in front, i.e., somewhat below the waist of the wearer. In the rear the waist band will be at the usual height. There will be two hip pockets but no side pockets.

The invention can also be applied to other garments such as briefs, pyjamas and the like, with certain modifications.

Figure 6:
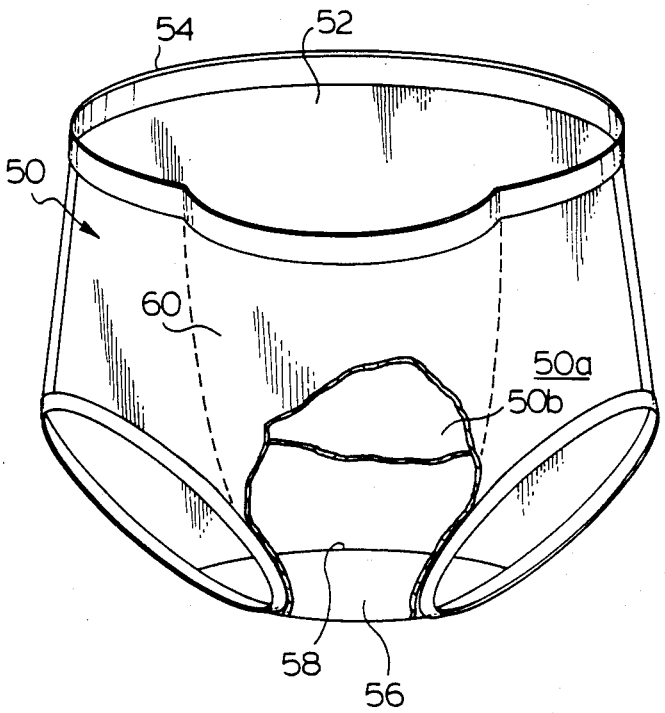
FIG. 6 is a front perspective partially cut away of a pair of briefs according to the invention.

A pair of briefs is illustrated in FIG. 6. It comprises a front panel 50, rear panel 52, and angled waist band 54.

The front panel 50 is formed of two thicknesses 50*a*, 50*b* of fabric. Panel 50 has a flap portion 56 extending through the crotch area.

Back panel 52 has a notch 58 to receive flap 56.

In an alternate form of construction, the front panel of the brief may incorporate a central area of mesh material indicated in phantom as 60, for greater ventilation.

Ventilated or mesh material may also be used in the regular trousers of FIGS. 1–5, as indicated in phantom at 62 (FIG. 1).

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A fabric trouser construction for the lower trunk defining a waist and cuffs and comprising a single integral front panel and a single integral back panel, and wherein said back panel comprises:

a seat portion for covering the seat and back, and two leg portions all cut integrally out of a single panel;

a generally upwardly curved edge defined by an upper edge of said seat portion a lower concavely curved edge extending partially into the seat region defined by a lower region of said seat portion, said seat portion, said two leg portions, said upper edge, and said lower region all being formed of a single integral piece of fabric;

and wherein said front panel comprises:

an abdomen portion for covering the front of the lower trunk, and two leg portions, all cut integrally out of a single panel;

a generally downwardly curved edge defined by an upper edge of said abdomen portion;

a downward extension of said abdomen portion defined by a lower edge of said abdomen portion forming a crotch section extending between the legs, and through the crotch area and, being joined to said lower concave edge of said back panel, said crotch section extending as a single integral strip from said abdomen portion through to the rear of the crotch area, as a single thickness of fabric, and wherein the edges of said crotch section extend partly down the inside of the upper leg on each side of the crotch area, and, seams joining said front and back panels along the outside of said leg portions, extending from the waist to the cuff of said garment, and further seams joining said front and back panels down the inside of the leg area, said further seams commencing at a point rearward of the crotch in said lower region of said seat portion, and extending diagonally forwardly along the inside of said leg portions to the center of the inside of the cuff thereby eliminating the intersection of seams in the crotch area of the trouser.

2. A garment construction as claimed in claim 1 including a central vent panel fastened in the centre of said front panel, formed of net material.

* * * * *